US005290209A

United States Patent [19]

Wilkinson

[11] Patent Number: 5,290,209

[45] Date of Patent: Mar. 1, 1994

[54] PUSH AND PULL EXERCISE DEVICE

[76] Inventor: William T. Wilkinson, P.O. Box 378, Chesapeak City, Md. 21915

[21] Appl. No.: 47,775

[22] Filed: Apr. 15, 1993

Related U.S. Application Data

[63] Continuation of Ser. No. 771,176, Oct. 4, 1991, abandoned.

[51] Int. Cl.[5] ..... A63B 1/00

[52] U.S. Cl. ..... 482/38; 482/121; 482/126; 482/123; 482/96; 482/140; 482/141; 482/142

[58] Field of Search ..... 482/38, 39, 95, 96, 482/121, 122, 126, 123, 140, 141, 142; 472/118, 119, 120, 121, 122, 123, 124, 125; 182/183, 184

[56] References Cited

U.S. PATENT DOCUMENTS

| | | | |
|---|---|---|---|
| 254,215 | 2/1882 | Heeseler | 482/38 |
| 2,325,592 | 8/1943 | Degler | 182/183 |
| 2,410,330 | 10/1946 | Ashenfelter | 182/184 |
| 2,817,522 | 12/1957 | Margulies | 482/38 |
| 3,752,473 | 8/1973 | LaLanne | 482/38 |
| 3,934,676 | 1/1976 | Rice | 182/183 |
| 4,804,064 | 2/1989 | Coultrup et al. | 182/183 |
| 4,822,031 | 4/1989 | Olschewski | 482/38 |
| 4,832,336 | 5/1989 | Lahman | 482/140 |

*Primary Examiner*—Richard J. Apley
*Assistant Examiner*—Lynne A. Reichard
*Attorney, Agent, or Firm*—Connolly and Hutz

[57] ABSTRACT

In accordance with this invention, a device is provided which is able to develop upper body strength, including doing exercising such as pull-ups, push-ups, tricep presses, tricep presses, dips, arm curls, flys, etc. Also with the device of the invention abdominal and leg muscles could be developed by such exercises as sit-ups, leg-lifts, leg extentions and back rests.

The exercise device preferably comprises a horizontal bar adapted for being selectively gripped by the hands of a user or supporting the user's legs. A means is included for adjusting the length of the bar. At least two sets of vertical support structures support the bar at at least two based locations. Each of the vertical supports structures includes means for adjusting the length of its structure whereby the elevation of said bar may be varied in accordance with a particular exercise program.

The device may be used for performing an exercise program by adjusting the horizontal bar to the desired length and adjusting the vertical support structures to the desired height. The horizontal bar is gripped by the user's hands. The user the moves his body towards the horizontal bar under the force from the user's and holds the body in place for a predetermined time. The body is then moved toward original position and the various steps are repeated until the exercise program is complete.

A similar exercise program may be performed by using additional parts with the device such as elastic bands or a slant board.

16 Claims, 11 Drawing Sheets

PUSH AND PULL EXERCISE DEVICE

This is a continuation of Ser. No. 07/771,176, filed Oct. 4, 1991, now abandoned.

BACKGROUND OF THE INVENTION

In today's society there is a growing need for new exercising devices. There is a need for a light-weight, portable exercising device that is good for the development of the arms, stomach, back and the legs. An ideal device must be adaptable for all different sizes of men, women and children.

SUMMARY OF THE INVENTION

An object of this invention is to provide an exercise device which meets the basic problems facing the exercise industry today.

A further object is to provide a light-weight, compact, portable, and sturdy exercising device.

In accordance with this invention, a device is provided which is able to develop upper body strength, including doing exercising such as pull-ups, push-ups, tricep presses, dips, arm curls, flys, etc. Also with the device of the invention abdominal muscles and leg muscles could be developed by such exercises as sit-ups, leg extensions, leg-lifts and back rests.

The exercise device preferably comprises a horizontal bar adapted for being selectively gripped by the hands of a user or supporting the user's legs. A means is included for adjusting the length of the bar. At least two sets of vertical support structures support the bar at at least two spaced locations. Each of the vertical supports structures includes means for adjusting the length of its structure whereby the elevation of the bar may be varied in accordance with a particular exercise program.

The device may be used for performing an exercise program by adjusting the horizontal bar to the desired length and adjusting the vertical support structures to the desired height. The horizontal bar is gripped by the user's hands. The user then moves his body towards the horizontal bar under the force from the user's hands and holds the body in place for a predetermined time. The body is then moved toward its original position and the various steps are repeated until the exercise program is complete.

A similar exercise program may be performed by placing the knees over the horizontal bar to do sit-ups, leg-lifts and back rests.

A BRIEF DESCRIPTION OF THE FIGURES

A DETAILED DESCRIPTION OF INVENTION

Figure 1:
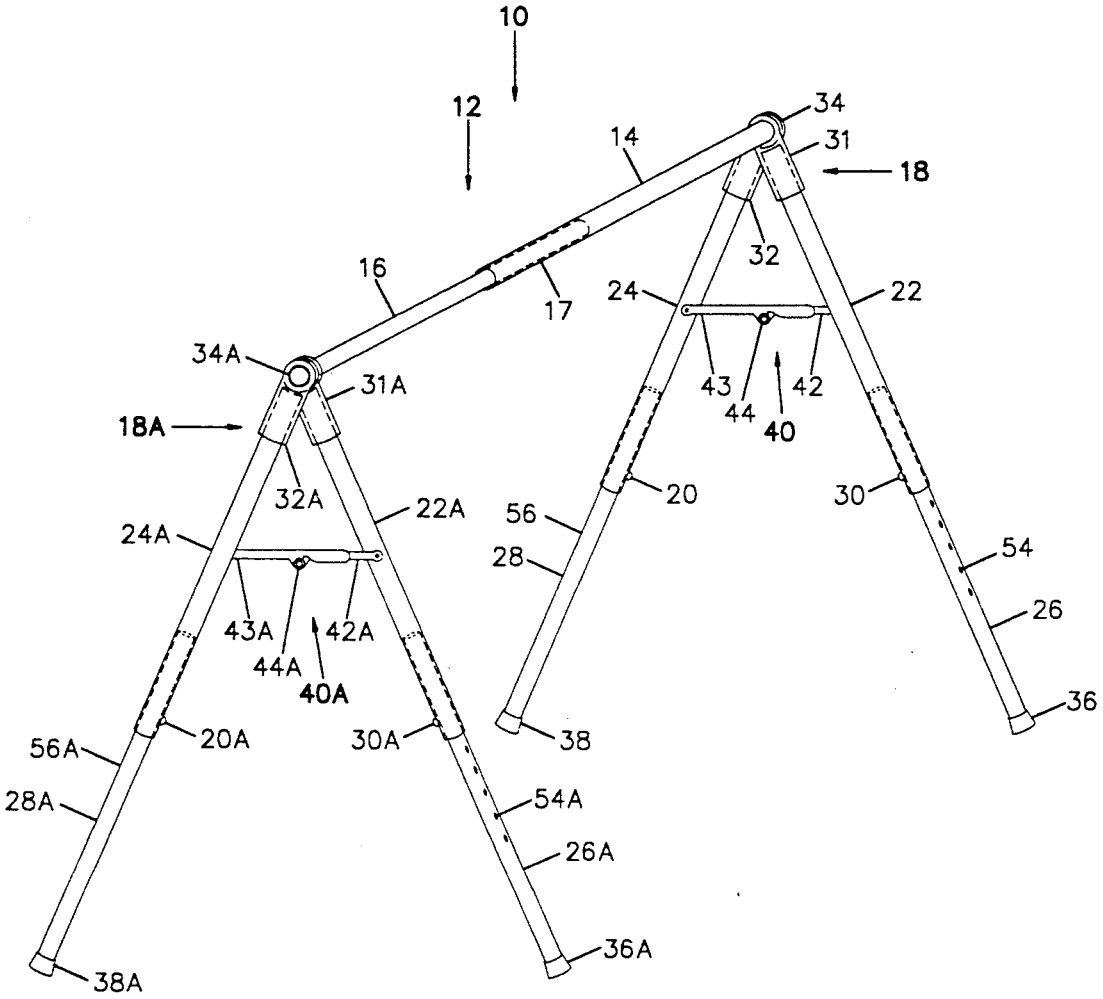
FIG. 1 is a perspective view of an exercise device in accordance with this invention.

FIG. 1 illustrates an exercise device 10 in accordance with this invention. Device 10 is useful for various types of exercise programs. Advantageously device 10 can be used by numerous individuals of different sizes and ages in accordance with different exercise needs. This is possible in part from the dimensional adjustability of the different components forming device 10.

In general device 10 includes a horizontal bar 12 which forms the main component used by user. Bar 12 is supported at each end by support structures 18, 18A. As later described, bar 12 is adjustable in length while structures 18, 18A are vertically adjustable to vary the height of bar 12.

Figure 1A:
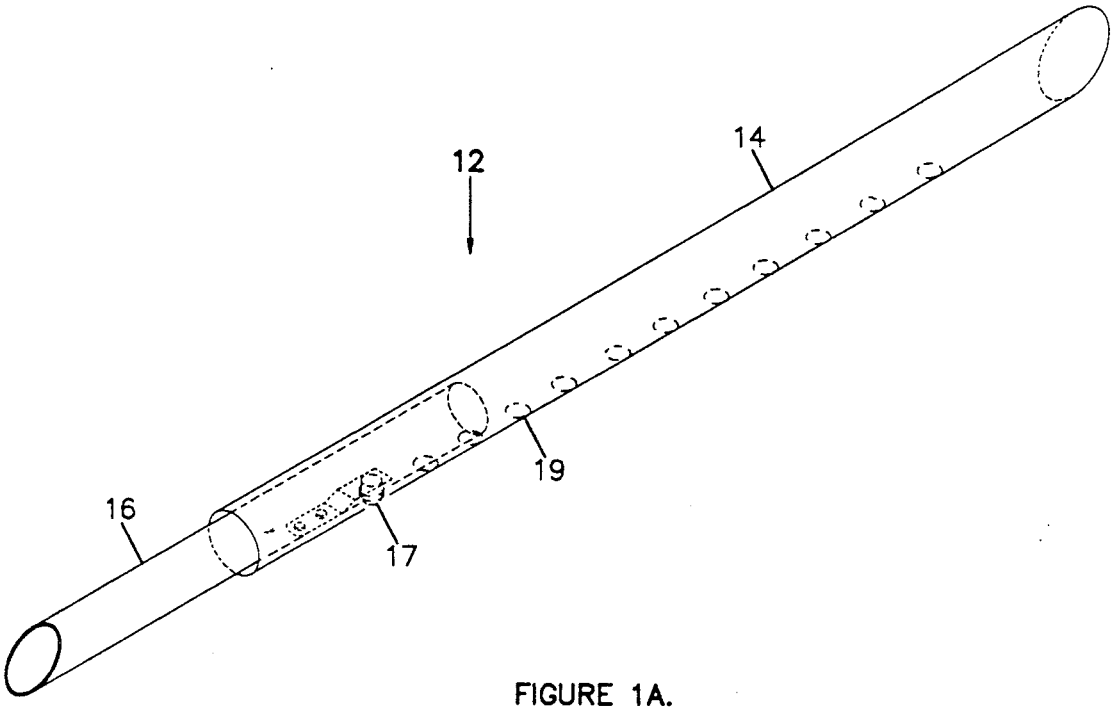
FIG. 1A is an enlarged perspective view of the bar of FIG. 1.

In the preferred practice of this invention, horizontal bar 12 is adapted for being selectively gripped by the hands of a user or supporting the user's legs. The horizontal bar 12 has a no-slip grip surface. The grip can be, but is not limited to a foam grip, a tape grip or knurl grip. The horizontal bar 12 is made from a hollow tube 14. The tubular bar preferably includes a number of aligned holes 19 (see FIG. 1A). The horizontal bar 12 also includes a smaller diameter tube 16 that slides inside of the tube 14 and can be adjusted to the proper width of the user. the smaller diameter tube 16 can be hollow or solid. One such method of adjusting the width is by the degree of telescoping the bar 16 into tube 14. A spring pin 17 can be mounted on the tube 16. The pin would snap through one of the aligned holes 19 on the larger diameter tube 14 to lock bar 12 to the desired length.

Connected to the horizontal bar 12 are vertical support structures 18 and 18A. Each vertical support structure can consist of, but is not limited to, an inverted V-shaped structure. Since structures 18 and 18A are identical, only structure 18 will be described in detail. Structures 18A will have similar components designated by the suffix "A".

As can be seen in FIG. 1, the inverted V-shaped support 18 consists of a pair of hollow tubular bars 22 and 24 which telescopically receive smaller diameter bars 26, 28, respectively. The extent of the telescoping of the two smaller diameter tubular bars 26 and 28 dictate the adjustability of the height of the device 10. One such method of adjusting the height is having a series of aligned holes in the outer tubes 22 and 24. The smaller diameter tubes 26 and 28 would have a spring pin 30 and 20 mounted respectively on the outside of the tubes which would fit in one of the aligned holes to control the extension of tubes 26, 28 and thus select the desired height. Tubes 22, 24 are connected to bar 12 by being inserted into sleeves 31, 32. Each sleeve 31, 32 has an annular extension which fits on a reduced diameter threaded end of bar 12 so that the sleeves 31, 32 may pivot around bar 12 during the assembly and adjusting of support structure 18. The sleeves are locked on bar 12 by an outer nut 34 threaded on bar 12. Sleeve 31 would hold the hollow tubular bar 22 and sleeve 32 would hold the hollow tubular bar 24. At the bottom of the smaller diameter tubular bars 26 and 28 would be non-slip grip feet 36 and 38.

Figure 8:
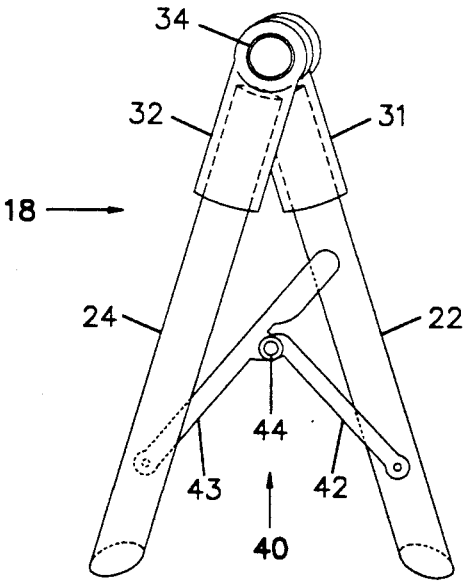
FIG. 8 illustrates an enlarged view of the hinge.

The width of the V-shaped support 18 is dependent upon the stabilizing structure 40. Structure 40 can be detachable. Structure 40 may be formed in any suitable manner but preferably is a conventional hinge structure comprising a pair of hinge arms 42, 43 selectively connected by a hinge pin 44. Each arm 42, 43 in turn is pivotally fastened to a corresponding tube 22 or 24 (see FIG. 8).

The material for the various tubular bars can be made from, but not limited to, plastic or metal. Device 10 is suitably dimensioned to permit device 10 to be used for the latter described exercises. For example, bar 12 may have maximum length of about 40 inches and may be elevated to a maximum height of about 36 inches. Tubing of about 1¼ inches could be used for bar 12 and structures 18, 18A.

Figure 2:
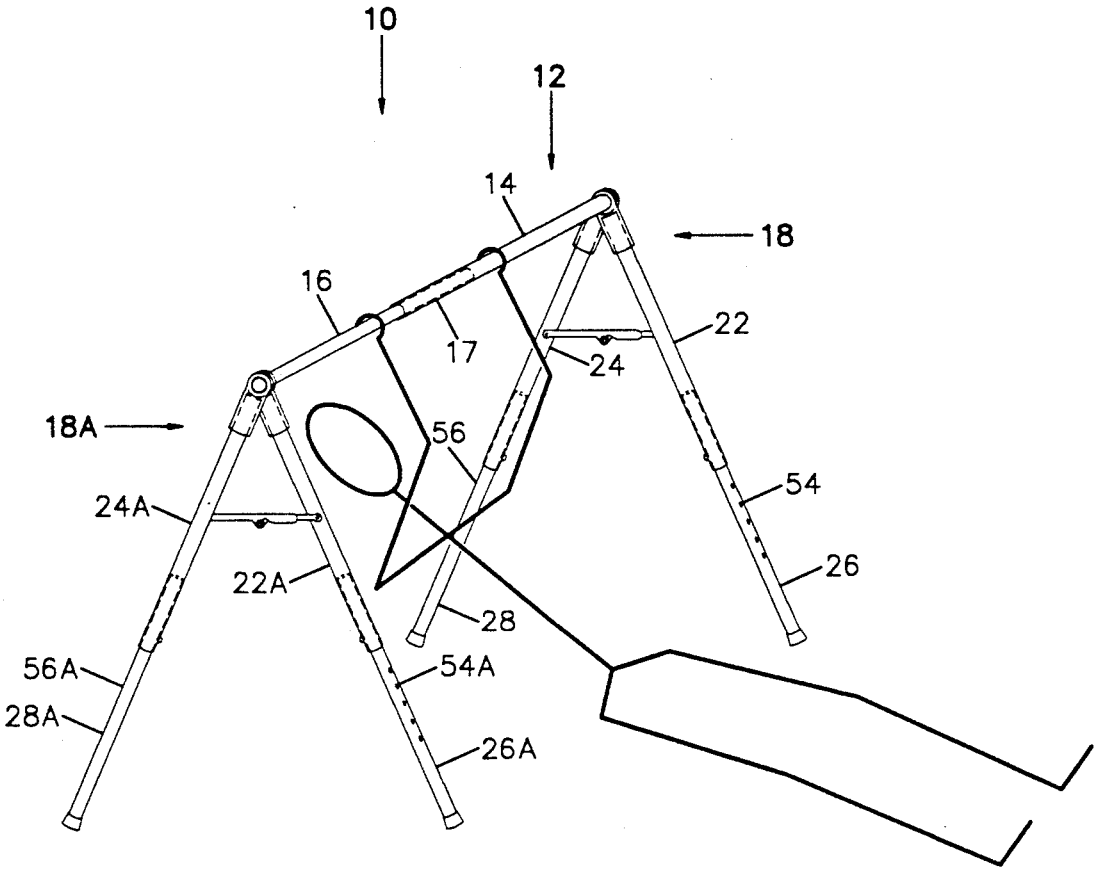
FIG. 2 shows the device of FIG. 1 as used for pull-ups.

FIG. 2 shows a method of using the device 10 for pull-ups. The user adjusts the horizontal bar 12 and the vertical supports 18 and 18A to the proper dimensions. The user lies beneath bar 12 and places his hands on the non-slip grip of the horizontal bar 12. The fingers of the hands may either be facing the user or away from the user. The person then raises his body holding the body in place for a predetermined time and then lowers the body toward the original position, repeating the steps until the exercise program is complete. As indicated, the user can have his hands placed either over the bar or underneath the bar and grip it, thereby doing forward pull-ups or reverse pull-ups.

Figure 3:
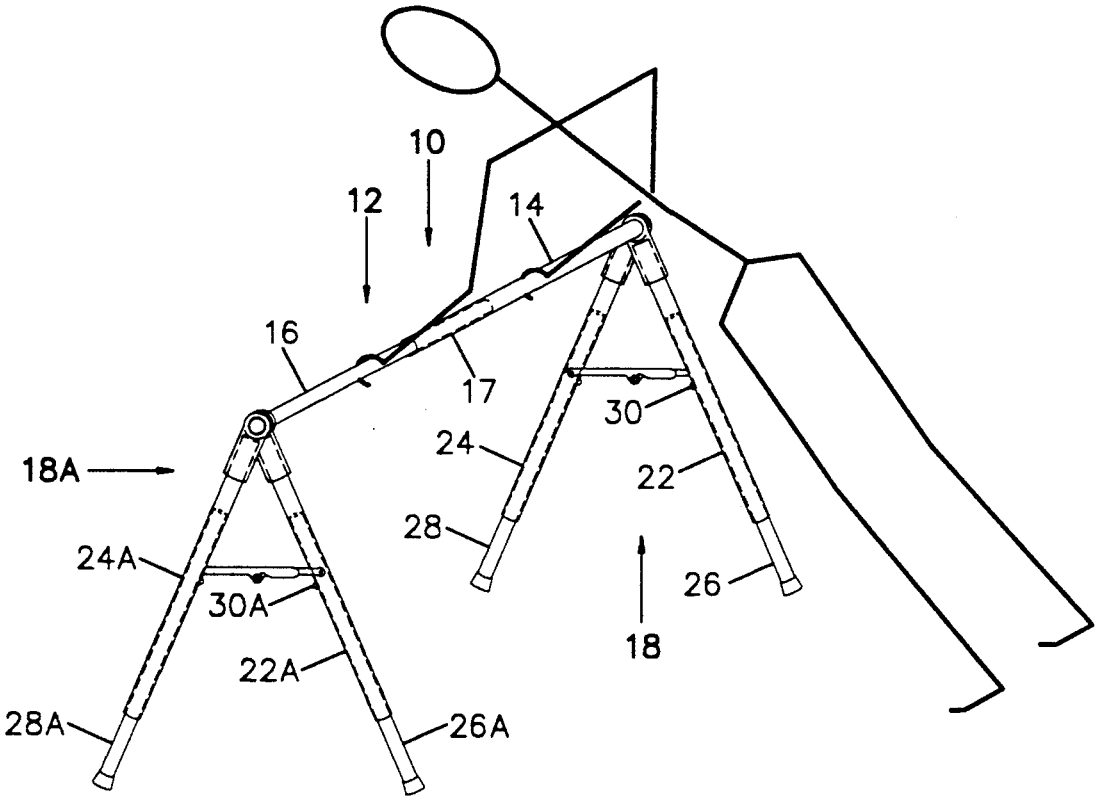
FIG. 3 shows the device of FIG. 1 as used for push-ups.

FIG. 3 shows a method of using device 10 for doing push-ups. The user would adjust the horizontal bar to the desired width and adjust the vertical supports to the desired height. The user could then grip the non-slip grip and do a series of push-ups. During the routine the person can change the adjustment of the vertical supports 18 and 18A to get a different workout for the push-ups.

Figure 4:
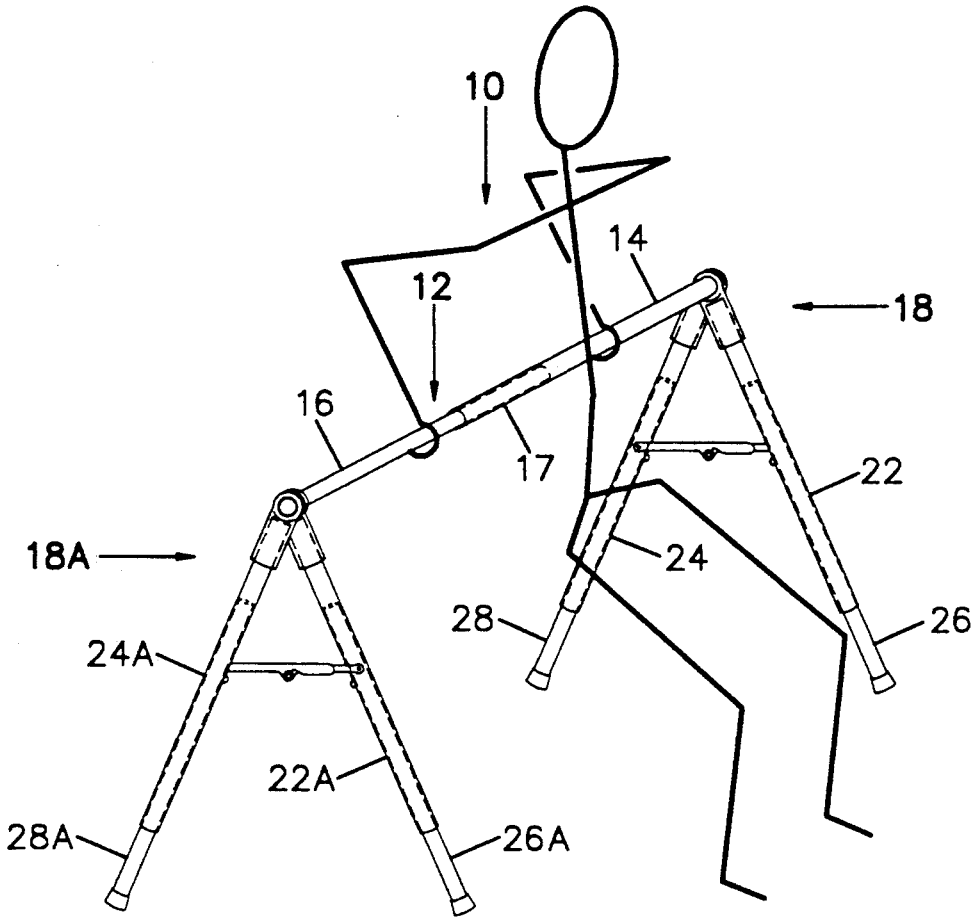
FIG. 4 shows the device of FIG. 1 as used for tricep presses.

FIG. 4 shows a user doing tricep presses. The user would grab the non-slip bar and bend down and then straighten up doing a series of tricep presses. Again, the user can adjust the height of the vertical supports 18 and 18A to change his routine.

Figure 5:
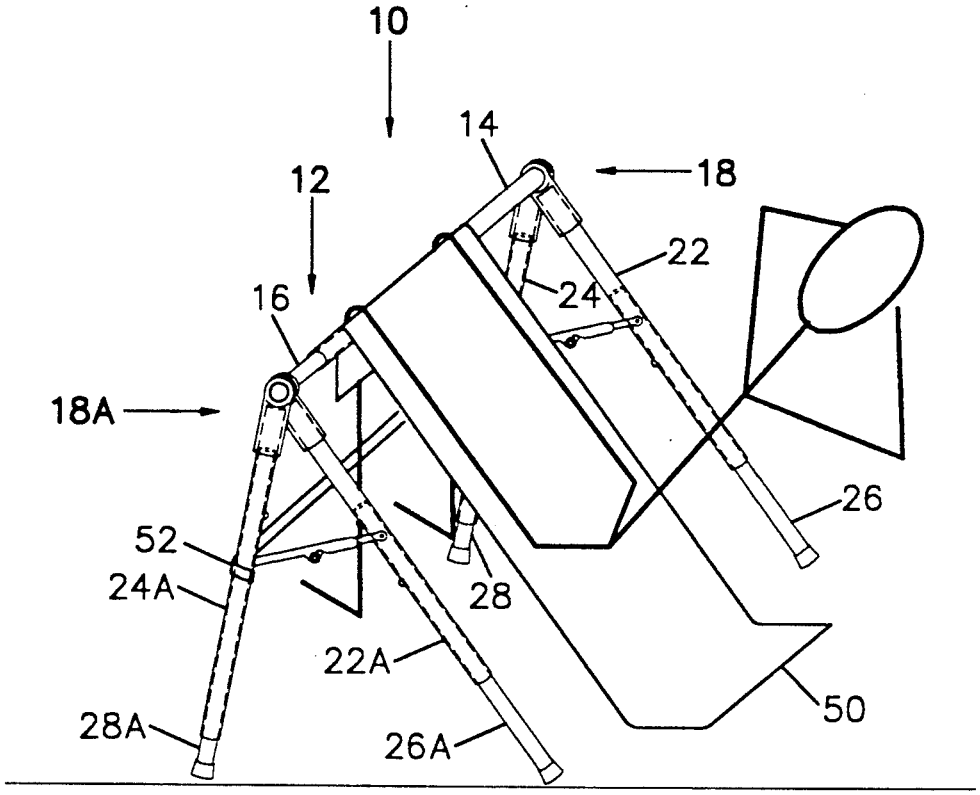
FIG. 5 shows the device of FIG. 1 as used with a clip-on slant-board for sit-ups.

FIG. 5 shows a user doing sit-ups with the device 10. FIG. 5 shows a clip-on slant board 50. The clip-on slant board fits on top of the horizontal bar 12. Slant board 50 is a rigid bendable plate having a pair of bent offset ends for fitting over bar 12 and for resting on a support surface. Board 50 may have C-clamps or spring clips where it engages bar 12 and is sufficiently strong to support the weight of the user. The bends in board 50 would be selected in accordance with the height of the bar 12. The user would adjust the width of the horizontal bar 12 and the height of the vertical supports 18 and 18A to the desired position, and then the slant board 50 to bar 12. The hollow tubular bars 24,24A would have a strap 52 attached to them. The strap can be, but is not limited to a flexible member having velcro or snap fasteners so that the strap 52 would be adjustable. The user would place the user's legs over the bar 12 and on the board 50. The user would tighten the strap 52 to make the strap taut and support the user's legs. The strap 52 could contain adjustable loops for fitting around and restraining the legs. Then the user could do a series of sit-up exercises raising his hands to his knees that are over the bar with the legs pressing against the strap 52 as shown in FIG. 5. The tubes 26 and 26A can be adjusted to a different length than tubes 28 and 28A. The difference in length would change the difficulty level of the sit-ups. Such length variation could also be used for other exercises. Although strap 52 is preferably flexible, it may be a rigid length adjustable bar.

Figure 6:
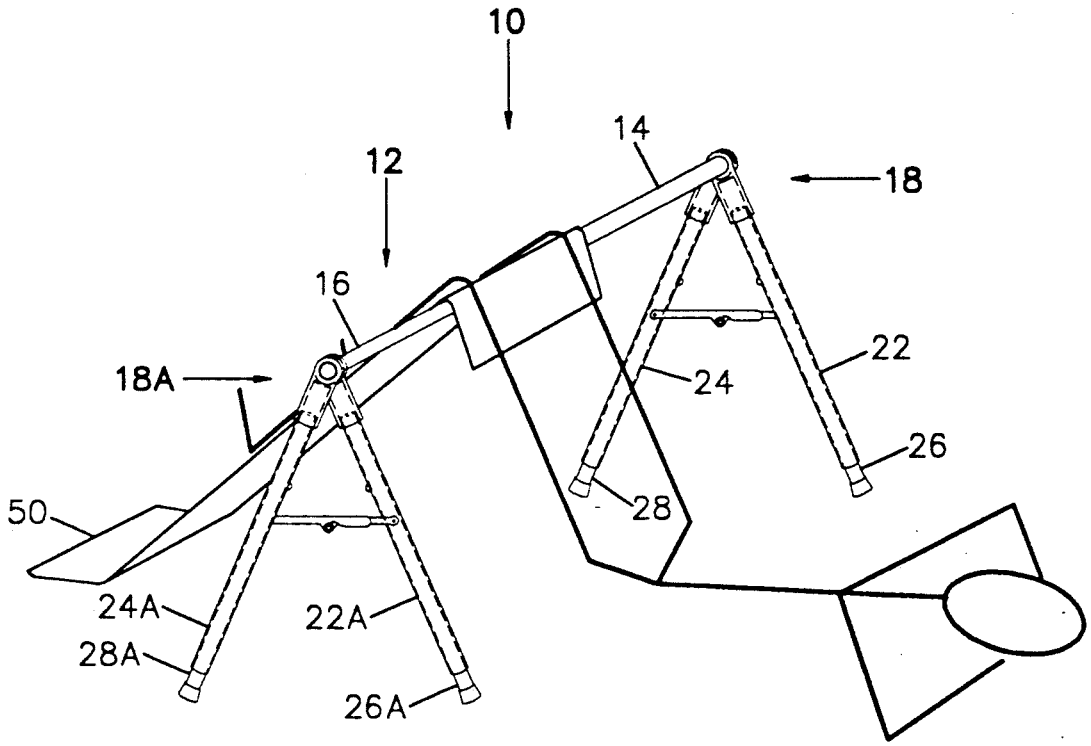
FIG. 6 shows the device of FIG. 1 as used to do leg or back rests.

FIG. 6 shows a user doing back or leg rests. A clip-on board 50 is mounted to the horizontal bar 12 in a different position where the legs are supported by board 50. The device is then again adjusted to the user's needs. The vertical supports 18 and 18A are adjusted and the horizontal bar 12 is adjusted then the person begins to do the series of exercises.

Figure 9:
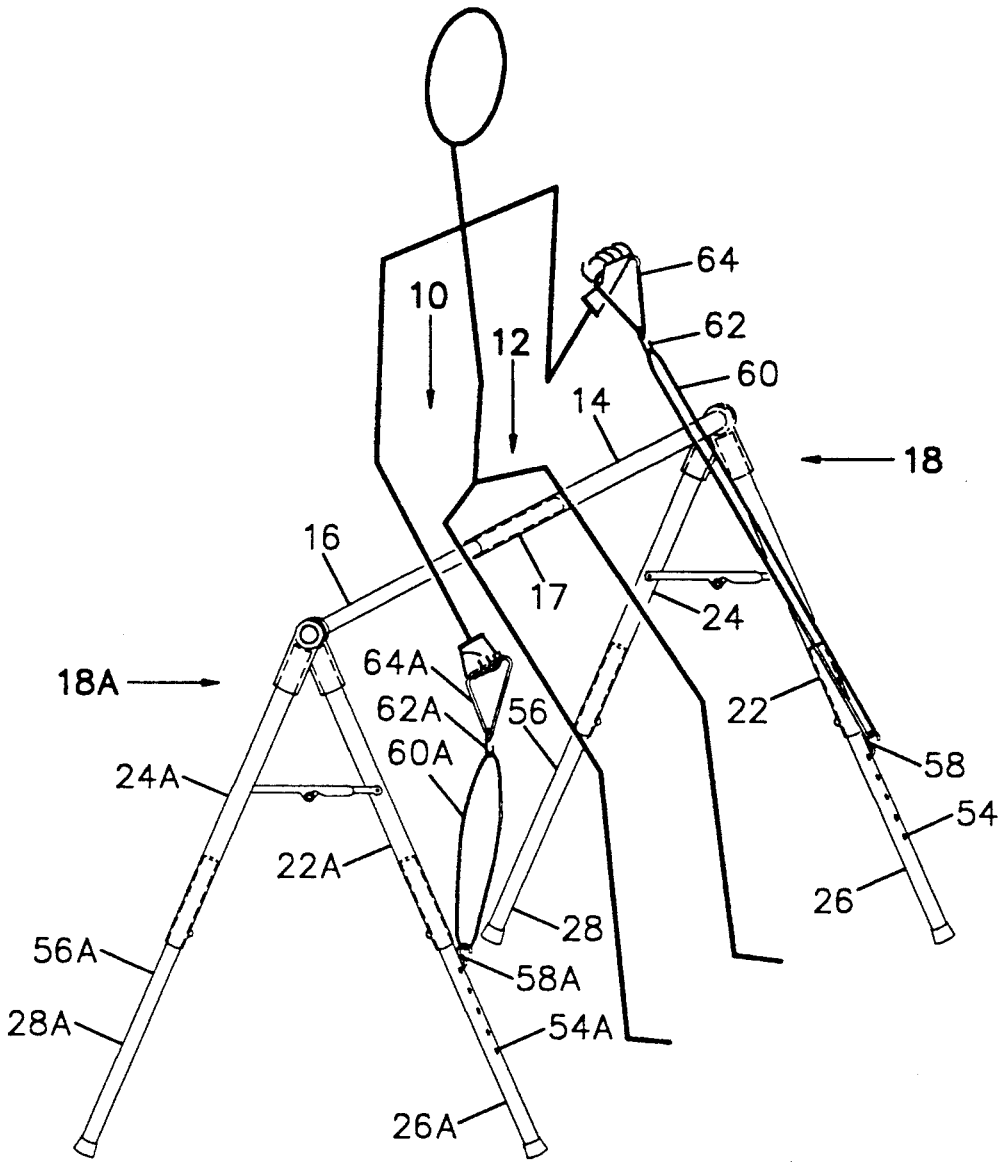
FIG. 9 shows the device of FIG. 1 as used for arm curls.

FIG. 9 shows a user doing arm curls. The tubes 26, 26A of device 10 have a series of aligned holes 54, 54A. Hooks 58, 58A would lock into the holes 54, 54A to the desired position. Resistance bands or cords 60, 60A would fit on the hooks 58, 58A. The opposite end of the resistance bands 60, 60A would be attached on hooks 62, 62A. Hooks 62, 62A would be attached to handle 64, 64A. The handles 64, 64A could be any shape such as but not limited to triangular, circular, square, rectangular, or even straight as a bar.

The user would adjust the height and width of device 10. Then user would sit on device 10. The user would grab the handles 64, 64A with each hand. The user would pull the handle 64 towards his body. The user would hold the handle 64 for the desired time and then release causing the tension in the band 60 to return to the rest position as can be seen in FIG. 9 looking at band 60A. The user would repeat the exercise until the user achieved the desired result. The user could alternate the right hand with the left hand. The user can even do an exercise routine pulling with both hands at once for a desired time and then release causing the tension in the bands 60, 60A to return to the rest position. The user would repeat the exercise until the user achieved the desired result.

Figure 10:
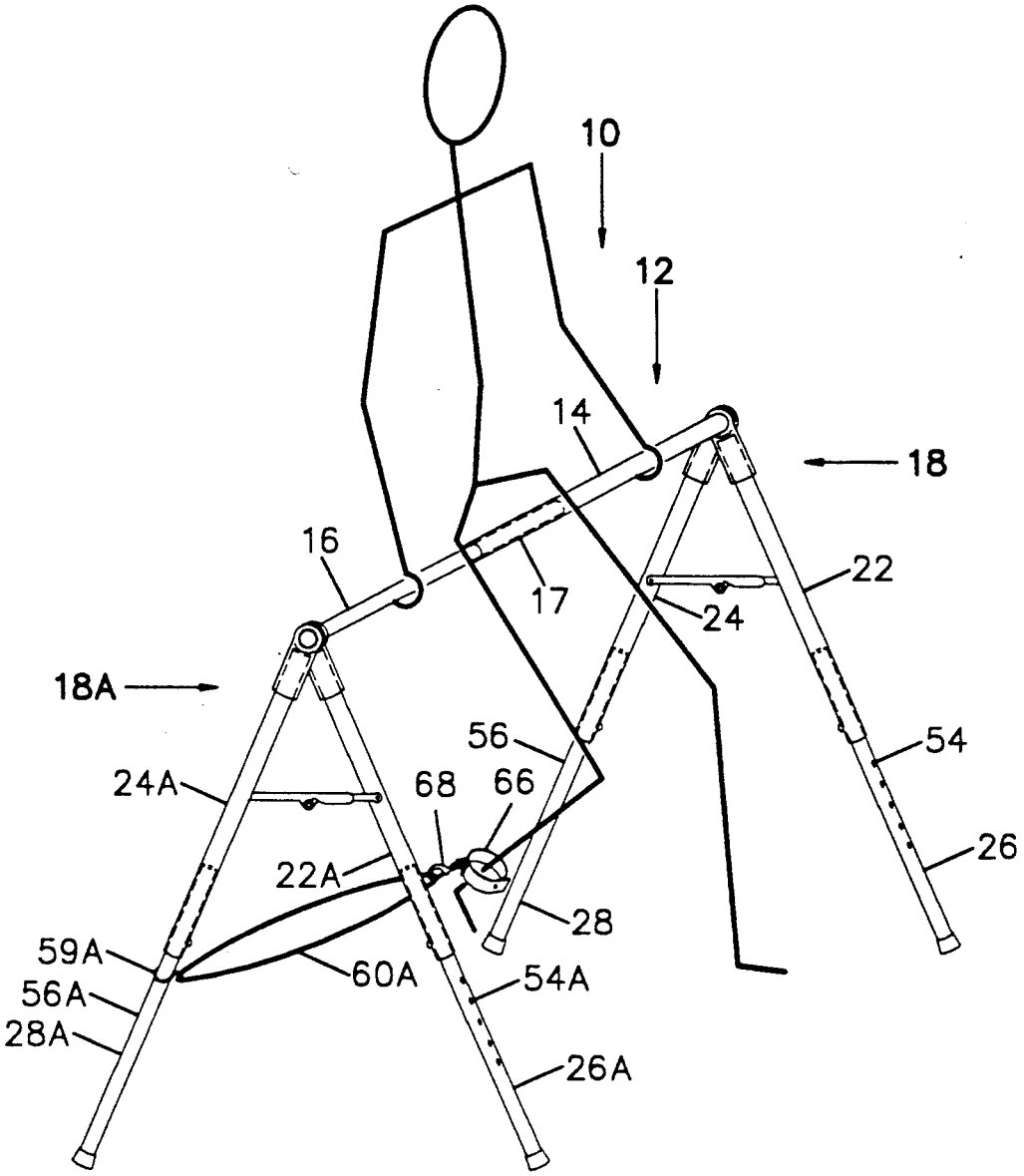
FIG. 10 shows the device of FIG. 1 as used for leg extensions.

FIG. 10 shows a user doing leg extensions. The back tubes 24, 24A of device 10 have a series of aligned holes 56, 56A. A hook 59, would lock into the holes 56A to the desired position. The same hook 59 would also fit in the holes 56A. Resistance band 60A would fit on the hook 59. The opposite end of the resistance band would fit on a hook 68. Hook 68 would be attached to an ankle collar 66.

The user would adjust the height and width of device 10. Then the user would sit on device 10. The user would put the ankle collar around the user's ankle. The user would straighten the user's leg causing tension on the resistance band 60A. The user would hold the leg for the desired time and then the user would bring the leg back to the original position. The user would repeat this exercise until the routine is complete. The user could alternate legs during the routine by hooking an additional ankle collar to the user's other leg and repeating the exercise with each leg used either alternatively or simultaneously.

Figure 11:
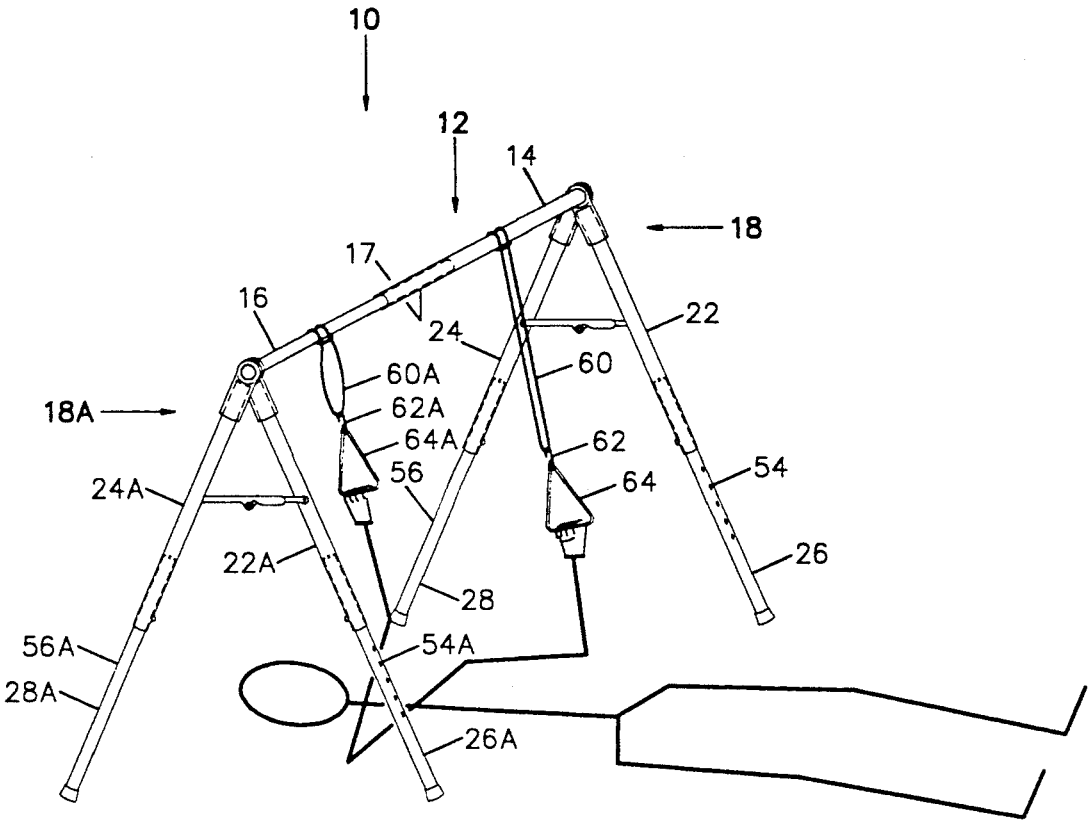
FIG. 11 shows the device of FIG. 1 as used for pull downs.

FIG. 11 shows a user doing pull downs. Resistance bands 60, 60A would be attached to the horizontal bar 12. The bands 60, 60A are looped over bar 12. Resistance bands 60, 60A also may be attached to horizontal bar 12 by two hooks through a series of aligned holes in tubes 14 and 16 (not shown in the figure). The opposite end of the band 60, 60A would be attached to hooks 62, 62A. The hooks 62, 62A would be fastened to handles 64, 64A.

The user would adjust the height and width of device 10. Then user would lie underneath the device 10 grabbing the handles 64, 64A with user's hands. The user's hands could face either direction depending upon the exercise being performed. The user would pull the handle 60 down toward the user's body and hold the handles for a time period. Then the user would relax and allow the band 60 to return to its rest position. The user would repeat this exercise until the user achieved the desired result. The user may use both handles 64, 64A simultaneously or alternate using one hand and then the other.

Figure 7:
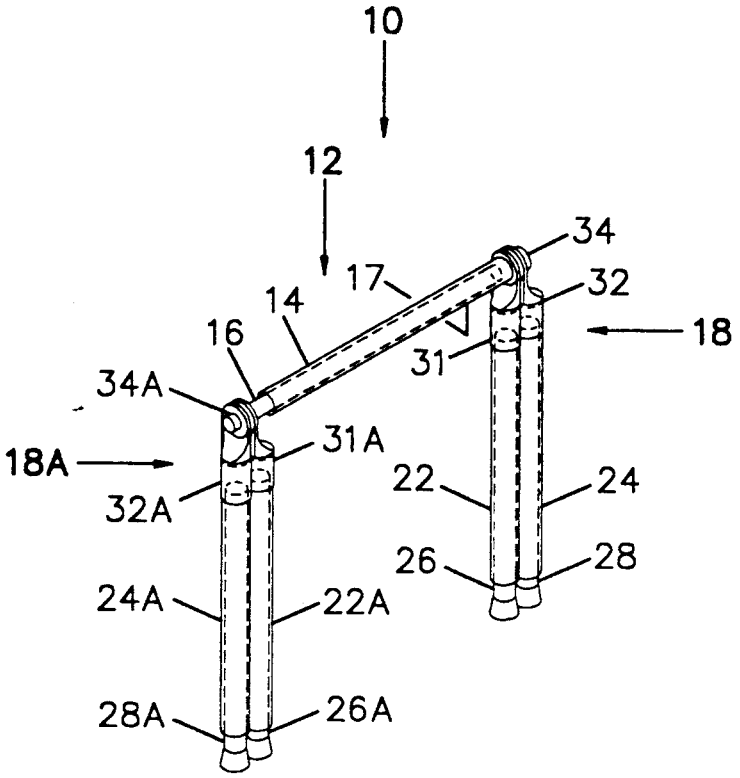
FIG. 7 illustrates the device of FIG. 1 in its stored condition.

Upon completion of any of the exercises, the device 10 is easily folded up so that can be put in a container and it is easily portable. FIG. 7 shows the device in its stored condition. The slant board additional could be wrapped around the device and used to store the device either alone or in the container. Strap 52 could also be wrapped around the stored unit.

The uses of device 10 are not limited to the specific exercises described herein. For example bar 12 can be adjusted to a length sufficient for simultaneous use by more than one person.

I claim:

1. An exercise device comprising two sets of spaced vertical support structures defining an open space therebetween, a horizontal bar adapted for being selectively gripped by the hands of a user or for supporting the user's legs, said horizontal bar being mounted to and spanning said support structures to maintain said support structures spaced from each other, said horizontal bar comprising a plurality of bars slidably mounted against each other to comprise a sliding horizontal bar unit which is adjustable in length for controlling the extent of said space between said support structures, each of said support structures comprising two sets of tubes slidably mounted against each other to adjust the overall height of each of said sets of tubes, each said sets of tubes comprising an upper tube and a lower tube, wherein the space between said supports is unconstrained, a movable lockable stabilizing structure connected to a respective tube of each of said sets of tubes to selectively maintain said sets of tubes in a fixed relation to each other, said stabilizing structure being connected to said upper tubes whereby said stabilizing structure may remain locked when said height of said sets of tubes is adjusted, each of said sets of tubes having an upper end and a lower end, said lower end being adapted to rest on the ground, and said upper end of each of said sets of tubes being pivotally mounted to said horizontal bar to permit said sets of tubes in each of said support structures to be pivoted toward each other in a side by side relationship with all of said tubes being aligned after said stabilizing structure has been unlocked and moved to from a compact unit for storage and transportation when said sets of tubes have been adjusted to their fully contracted shortest height and said sliding horizontal bar unit has been fully contracted to its shortest length and said device has an attachment means which would be allow other exercising attachments to be attached to said device for engaging of exercises.

2. An exercise device as claimed in claim 1, wherein said vertical support structures consist of an inverted V-shaped supports.

3. A device as claimed in claim 2, wherein each of said inverted V-shaped supports includes a set of telescopically mounted tubes selectively locked by a spring pin for adjusting the height of said bar.

4. A device as claimed in claim 3, wherein said horizontal bar comprises a set of telescopically mounted tubes selectively locked by a spring pin for adjusting the length of said bar.

5. A device as claimed in claim 3, wherein the vertical support structures consist of front and back vertical support tubes and said front vertical support tubes are adjusted to a different height than the back vertical support tubes.

6. A device as claimed in claim 2, further comprising clip-on slant board mounted to the horizontal bar.

7. A device as claimed in claim 6, wherein an adjustable strap spans said supports for being contacted by the user's legs.

8. A device as claimed in claim 2, wherein the maximum length of said bar is around 40 inches, the maximum height of said device being is around 36 inches, and said tubes are about 1½ inch in diameter.

9. A device as claimed in claim 2, wherein the hoizonal bar has a foam grip surface.

10. A device as claimed in claim 2, wherein the hoizonal bar has a non-slip tape grip surface.

11. A device as claimed in claim 2, wherein the hoizonal bar and said support structures are foldable upon each other to comprise a compact unit in its stored condition.

12. The device as claimed in claim 1, wherein the exercise attachment is at least one resistance band mounted having one end of said band connected to said device.

13. The device as claimed in claim 12, wherein the resistance band connected at one end to said device has a handle connected the opposite end of said band.

14. The device as claimed in claim 12, wherein at least one resistance band is mounted to said horizonal bar.

15. The device as claimed in claim 12, wherein at least one resistance band is mounted to said vertical supports.

16. The device as claimed in claim 15, further comprising an ankle collar attached to said resistance band whereby enabling a user to fit his foot in said ankle collar and perform exercises to strengthen the legs.

* * * * *